US006044933A

United States Patent [19]

Johansson et al.

[11] Patent Number: 6,044,933

[45] Date of Patent: Apr. 4, 2000

[54] HYDRAULIC ELEVATOR

[75] Inventors: Kjell Johansson, Växjö; Per Folkesson, Ingelstad, both of Sweden

[73] Assignee: Inventio AG, Hergiswil NW, Switzerland

[21] Appl. No.: 09/042,752

[22] Filed: Mar. 17, 1998

[30] Foreign Application Priority Data

Mar. 24, 1997 [EP] European Pat. Off. ..... 97-810173

[51] Int. Cl.[7] ..... B66B 9/04

[52] U.S. Cl. ..... 187/272; 187/414

[58] Field of Search ..... 187/272, 275, 187/250, 285, 414, 413

[56] References Cited

U.S. PATENT DOCUMENTS 4,066,148 1/1978 Brown ..... 187/17

FOREIGN PATENT DOCUMENTS 0 680 921 11/1995 European Pat. Off. .
0680921 11/1995 European Pat. Off. .
267 971 5/1989 Germany .
02163279 6/1990 Japan .
03147693 6/1991 Japan .
3147693 6/1991 Japan .
07301201 11/1995 Japan .
WO 97/42119 11/1997 WIPO .

*Primary Examiner*—Kenneth W. Noland
*Attorney, Agent, or Firm*—MacMillan, Sobanski & Todd, LLC

[57] ABSTRACT

A drive system for a hydraulic elevator installation (1) without a machine room including an electric motor (15), a hydraulic pump (16), an oil tank (17), valves (18) and a control apparatus (19) mounted in a cabinet (10). The cabinet (10) can be mounted in direct connection with an elevator shaft (2), for example near a shaft door (6), or at any desired location, preferably in the proximity of traffic routes, in work areas or even in passageways, where good accessibility is guaranteed. A double sound insulation of the cabinet (10) and of the oil tank (17) containing the electric motor (15) and the hydraulic pump (16) damps the noise level of the drive system to the extent that the cabinet (10) can be placed at virtually any desired location without the noise developed by the drive system being disturbing in surrounding spaces.

17 Claims, 3 Drawing Sheets

HYDRAULIC ELEVATOR

BACKGROUND OF THE INVENTION

The present invention relates to a hydraulic elevator installation, without a machine room, comprising a drive system that can be located in a cabinet anywhere in a building.

There is shown in the German patent document DD 261 971 an electro-hydraulic elevator, that is equipped with a stroke multiplier and in which the hydraulic drive and the control unit are arranged outside the elevator shaft at positions which am not specifically defined, wherein two separate boxes, which are not further described, are provided for the accommodating. The hydraulic drive is connected with the working cylinder by way of pressure lines.

The task of the above-described electro-hydraulic lift lies in developing a solution for a hydraulic elevator with a large stroke length. In that case a separate machine room was also dispensed with. Drive and control are merely accommodated in simple boxes in this solution. However, hydraulic drives, especially the pumps, during operation produce a high, unpleasant level of noise, which undamped can be tolerated neither by the residents of a residential building nor by the personnel of an office building. For this reason this prior art drive system and drive control usually has to be accommodated in, for example, basements with low utility. Moreover, it is desirable that, in the case of damage to the drive or to the oil tank, outflowing oil can be safely caught. In addition, the previously known arrangement of drive and control demands a large base area.

SUMMARY OF THE INVENTION

The present invention concerns a hydraulic drive for a hydraulic elevator installation having an elevator car movable in an elevator shaft. The drive includes a hydraulic cylinder adapted to move the elevator car in the elevator shaft; and a drive system connected to the hydraulic cylinder that can be selectively positioned at different locations in a building. The drive system includes a hydraulic pump connected to the hydraulic cylinder by a pressure line, an electric motor driving the hydraulic pump, and a cabinet housing the hydraulic pump and the electric motor and having a multi-layer sound insulation. The electric motor and the hydraulic pump are enclosed within an oil tank and surrounded by hydraulic oil, the oil tank being mounted in the cabinet. The insulation includes a first insulation layer enclosing the oil tank and a second insulation layer mounted at an interior wall of the cabinet including at a pivotable door attached to the cabinet.

The present invention is based on the object of providing a hydraulic elevator installation, without a machine room, that does not exhibit the aforesaid disadvantages and in which the drive system (drive and control) is constructed in a space-saving manner and can be accommodated in the building to be readily accessible at any location without prejudicing the utilization of adjoining areas.

The advantages achieved by the present invention are essentially that through the proposed insulation of the drive system, or of the drive system itself, and of the cabinet virtually no audible sounds are emitted any longer. Thus, the arrangement of the cabinet together with the drive system can be effected in any building in the proximity of traffic routes, passageways or work areas without loss of comfort.

Advantageous developments and improvements of the hydraulic elevator installation according to the present invention, without a machine room, are that for further reduction in noise there can be used for the motor control a soft-starter, that is equipped with thyristors instead of relays, so that the control does not have any mechanical switching elements which cause switching noises. In addition, through the accommodation of drive and control in a single cabinet, the drive system can be prefabricated or equipped in the factory, whereby expensive assembly and installation costs on site can be avoided. Further, through the arrangement of the drive system in direct connection with the elevator shaft, for example near the shaft door, the cooling of the drive can take place directly by way of the elevator shaft. Finally, this arrangement facilitates maintenance operations, as a service engineer can visually monitor the elevator car or the shaft itself from the drive system.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
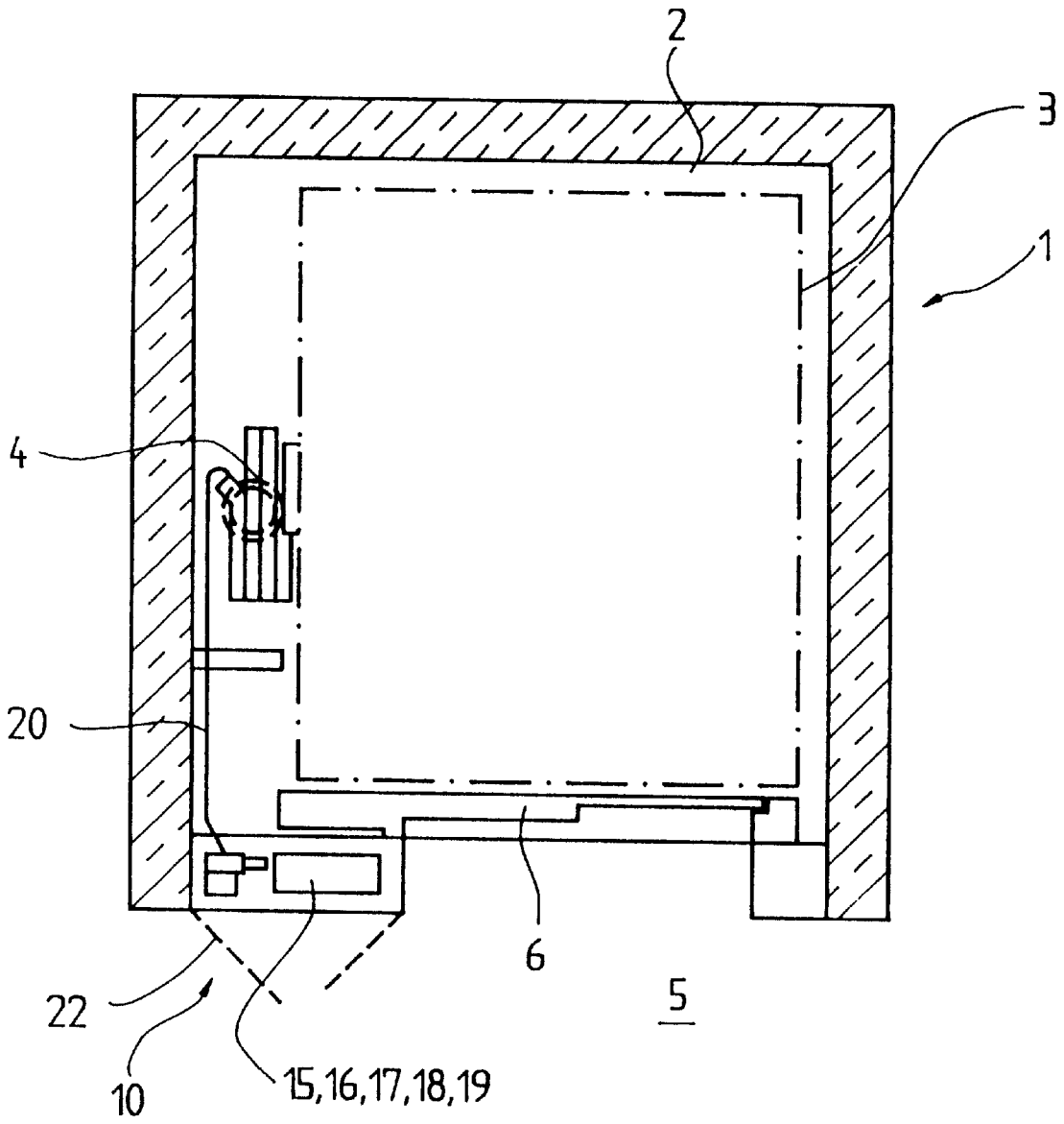
FIG. 1 is a top plan view of a hydraulic elevator installation with a drive system according to the present invention arranged near the elevator shaft door.

The FIG. 1 is a top plan view of a hydraulic elevator installation 1. A load carrying car 3 is movable upwardly and downwardly in an elevator shaft 2 by means of a hydraulic cylinder 4. The arrangement of the hydraulic cylinder 4 in the shaft 2 is effected in accordance with the respective elevator construction, for example as a central lifting arrangement or "rucksack" arrangement with one hydraulic cylinder 4 or as a tandem arrangement with two of the hydraulic cylinders 4 (not shown). A shaft door 6 enables access to the elevator car at each floor 5. The shaft door 6 can be an automatic telescoping door, a simple central opening or even a central opening telescopic door.

Equally possible would be the use of a rotary panel door. A cabinet 10 is placed near the shaft door 6. This cabinet 10 contains the entire drive system for moving the car 3.

Included in the drive system are an electric motor 15, a hydraulic pump 16 driven by the motor, an oil tank 17, valves 18 and an entire control apparatus 19. The hydraulic pump 16 is connected with the hydraulic cylinder 4 by way of a pressure line 20 through the valves 18.

The space requirement for the width of the cabinet 10 embraces merely the space for the lateral door opening for the shaft door 6, for example a telescopic door. As the cabinet 10 also does not substantially project into the shaft 2 and does not obstruct the door opening process, a standardized shaft door 6 as explained above can be used. Further, the cabinet 10 is equipped at a front side with pivotable doors 22 provided with a lock. When the doors 22 are opened, maintenance, assembly or repair operations can be undertaken at the drive system. With the placing of the cabinet 10 adjacent the shaft door 6 the advantage results that a service engineer during the work on the drive system can directly visually monitor the elevator car 3 or the shaft 2. This is not possible with the hydraulic elevators that are known today, which have a separate machine room.

The placing of the cabinet 10 is not, however, limited to the region near the shaft door 6. Due to the small dimensions of the drive system, the cabinet 10 can be relatively narrow, whereby it can be accommodated virtually anywhere in a building. Preferably this is in the proximity of traffic routes, in work areas or even in passageways, where good accessibility is guaranteed. Thereby, a separate machine room, which causes high costs, can be dispensed with.

In addition, the entire drive system can be prefabricated in the factory and built into the cabinet 10. The cabinet 10 is delivered with the built-in drive system to the elevator installation site, whereby the assembly and installation operations at the settingup position of cabinet 10 and the laying out of the pressure line 20 are limited.

Figure 2A:
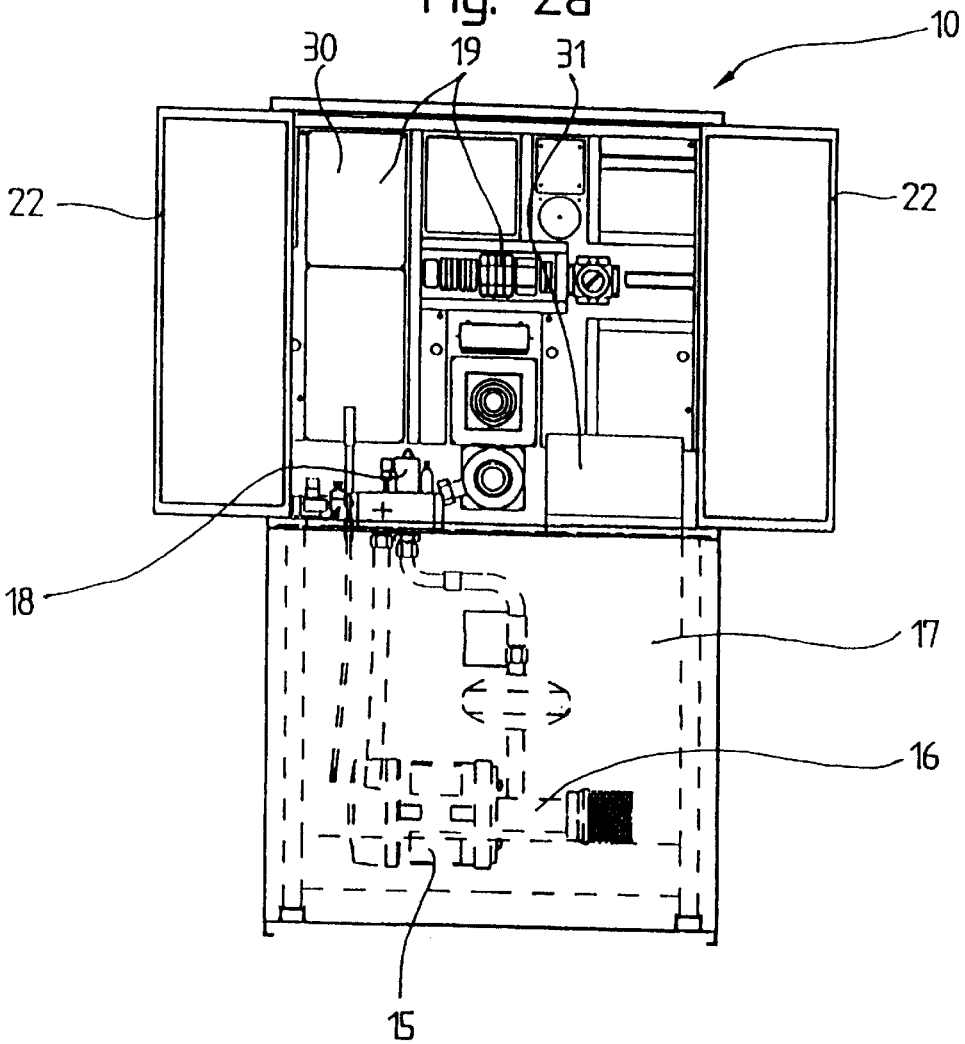
FIG. 2*a* shows a schematic view of a cabinet housing the drive system shown in the FIG. 1.
Figure 2B:
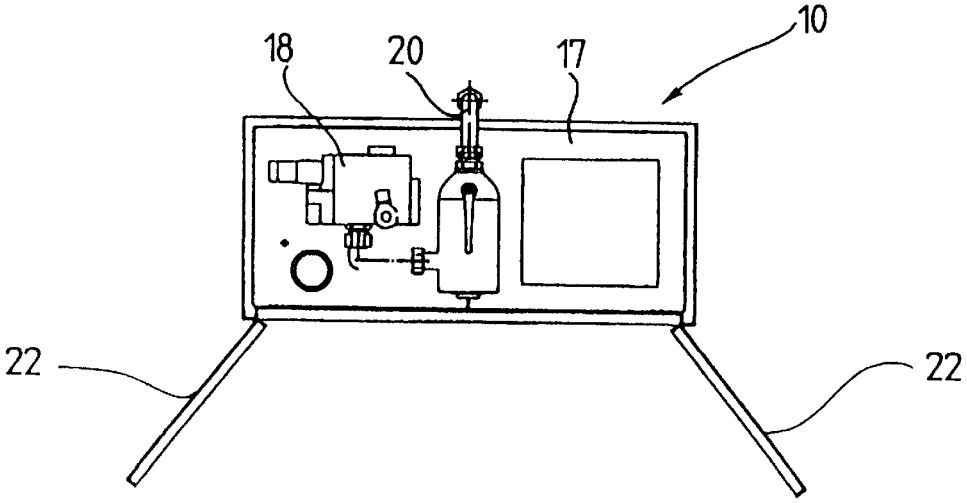
FIG. 2*b* is a schematic top plan view of the cabinet shown in the FIG. 2*a* with a top panel removed.

The FIGS. 2*a* and 2*b* show a schematic elevation view and a schematic plan view hydraulic pump 16 can be arranged in the cabinet 10 either vertically or horizontally (as shown). The electric motor 15 and the pump 16 are accommodated in this vertical or horizontal position in the oil tank 17, where they are surrounded by hydraulic oil. In order to adhere to safety requirements or possible legal conditions with respect to escaping oil, the cabinet 10 itself is so sealed that no hydraulic oil can leak out. A separate oil sump is thus unnecessary.

The valves 18 and the entire control apparatus 19 are accommodated above the oil tank 17. The control apparatus 19 essentially consists of a car control 30 and a drive control 31. The drive control 31 can, as is usual nowadays, be equipped with switching relays. However, there also exists the advantageous possibility of providing a so-called soft-starter utilizing thyristors in place of the relays. The mechanical switching noises, which are disturbing in certain cases, of the relays are thereby eliminated. In this way the entire control apparatus 19 operates virtually noise-free. The method for controlling the valves 18 is carried out according to the method described in the European published application EP 0 643 006, which enables a direct travel to a floor without travel at a crawling speed. Through this method the hydraulic oil is heated up significantly less than in the case of methods in which, shortly before reaching the floor, there is switching to a low, constant crawling speed. Disposed in the lowermost part of the cabinet 10 are the oil tank 17 and, in vertical or horizontal arrangement, the electrical drive 15 and the hydraulic pump 16. The valves 18 are positioned above the oil tank 17. The control apparatus 19 with the car control 30 and the drive control 31 is accommodated at the walls in the upper part of the cabinet 10.

The doors 22, provided with a lock 32, completely cover, in closed state, the entire drive system. The cabinet 10 is not recognizable as an elevator drive. In order to damp the noises of the drive, especially the hydraulic pump 16, a multi-layer, for example double, sound installation is provided. As shown in the FIG. 2*c*, a first insulation layer 35 encloses the entire oil tank 17, which also contains the electric motor 15 and the hydraulic pump 16. A second insulation layer 36 is mounted on the interior walls of the cabinet 10. The insulating layers 35 and 36 consist of commercially available insulation mats.

Due to this double sound insulation, but especially in addition because the two insulating layers 35 and 36 do not lie directly against one another but are separated from one another by an intermediate air space, there results a sound insulation of the drive system which falls below even the noise level of 50 dBA accepted in sleeping areas. In consequence of this insulation, the cabinet 10 can be located at virtually every desired location without the noise development of the drive system having to be taken into consideration for the erection site of the cabinet 10.

Figure 2C:
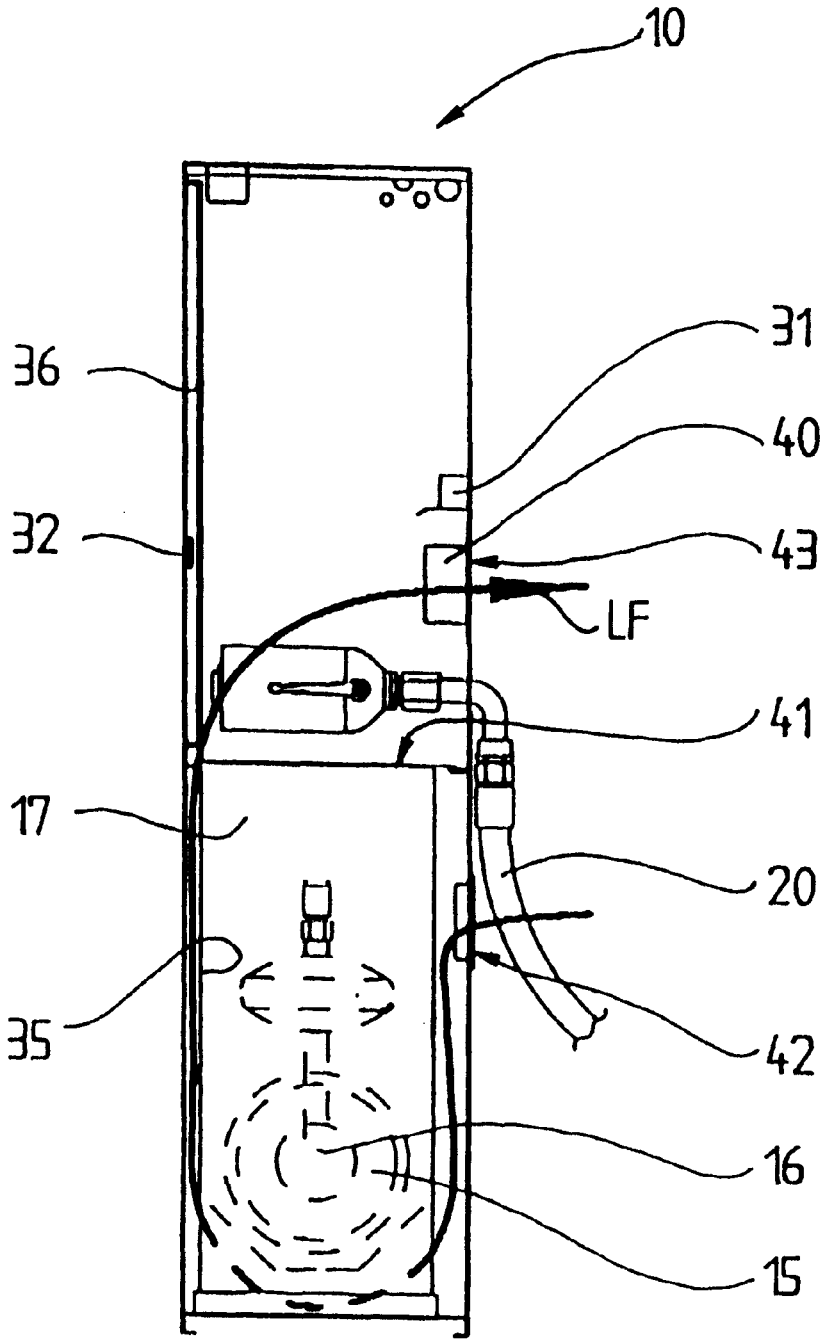
FIG. 2*c* is a schematic right side view of the cabinet shown in the FIG. 2*a* with the right side panel removed.

The FIG. 2*c* shows a side view of the cabinet 10. Two different possibilities for the aeration or ventilation of the interior of the cabinet 10 exist respectively according to the erection site. If the cabinet 10 is in direct connection with the elevator shaft 2, for example near the shaft door 6, an air flow LF can take place through inlet and outlet openings in the back wall of the cabinet 10 by means of a ventilator 40 and by way of the shaft 2. In that case the ventilator 40 is, for example, arranged above the oil tank 17 and the oil tank is provided with a cover 41 which is tightly connected at three sides with the cabinet 10. Air is now inducted through a first or inlet opening 42 in the back wall by the ventilator 40. Due to the cover 41 being sealed at three sides, the air flow LF flows within the cabinet 10 around the oil tank 17, and by way of the single side of the cover 41 which is not sealed off, reaches a second or outlet opening 43 in the back wall of the cabinet 10 and thus effects an optimum cooling. In the case of a setting-up of the cabinet 10 at a distance from the shaft 2, a separate system for feed and discharge of the cooling air of the cabinet 10 is needed apart from the ventilator 40.

As an alternative solution, an oil sump could be provided in the lowermost part of the cabinet 10, which would catch possibly escaping hydraulic oil. However, in order to keep the dimensions of the cabinet 10 as small as possible, the volume of the oil sump is smaller than the volume of the hydraulic oil. In order to adhere to safety requirements with respect to escaping oil, a discharge hose is connected to the oil sump and conducts away the outflowing hydraulic oil into a catch tank set up at a distance or into the sealedoff shaft well and collects it there.

In summary, the hydraulic drive for the hydraulic elevator installation 1 having the elevator car 3 movable in the elevator shaft 2 includes: the hydraulic cylinder 4 adapted to move the elevator car in the elevator shaft; and the drive system connected to the hydraulic cylinder that can be selectively positioned at different locations in a building, the drive system including the hydraulic pump 16 connected to the hydraulic cylinder by the pressure line 20, the electric motor 15 driving the hydraulic pump, and the cabinet 10 housing the hydraulic pump and the electric motor and having a multilayer sound insulation. The electric motor 15 and the hydraulic pump 16 are enclosed within the oil tank 17 and surrounded by hydraulic oil, the oil tank being mounted in the cabinet 10. The insulation includes the first insulation layer 35 enclosing the oil tank 17 and the second insulation layer 36 mounted at an interior wall of the cabinet 10 including at the pivotable door 22 attached to the cabinet.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A hydraulic drive for a hydraulic elevator installation having an elevator car movable in an elevator shaft comprising:

a hydraulic cylinder adapted to move an elevator car in an elevator shaft;

a drive system connected to said hydraulic cylinder that can be selectively positioned at different locations in a building, said drive system including a hydraulic pump connected to said hydraulic cylinder by a pressure line, an electric motor driving said hydraulic pump, and a cabinet housing said hydraulic pump and said electric motor and having a multi-layer sound insulation; and a drive control equipped with a low-noise soft-starter located in said cabinet and connected to control said electric motor.

2. The hydraulic drive according to claim 1 wherein said electric motor and said hydraulic pump are enclosed within an oil tank and surrounded by hydraulic oil, said oil tank being mounted in said cabinet.

3. The hydraulic drive according to claim 2 including a first insulation layer enclosing said oil tank and a second insulation layer mounted at an interior wall of said cabinet including at a pivotable door attached to said cabinet.

4. The hydraulic drive according to claim 1 including an oil sump formed in a bottom portion of said cabinet.

5. The hydraulic drive according to claim 4 wherein said oil sump is adapted to be connected by means of an outflow hose with one of a shaft well and a catch tank.

6. The hydraulic drive according to claim 1 wherein said cabinet is sized to be positioned adjacent a shaft door of the hydraulic elevator installation.

7. The hydraulic drive according to claim 1 including a control apparatus mounted in said cabinet and connected to said motor.

8. The hydraulic drive according to claim 7 wherein said control apparatus includes a drive control connected to said motor and a car control connected to said drive control.

9. The hydraulic drive according to claim 1 wherein said drive system is assembled as a unit prior to delivery of said cabinet to the site of the hydraulic elevator installation.

10. A hydraulic drive for a hydraulic elevator installation having an elevator car movable in an elevator shaft comprising:

a hydraulic cylinder adapted to move an elevator car in an elevator shaft; and a drive system connected to said hydraulic cylinder that can be selectively positioned at different locations in a building, said drive system including a hydraulic pump connected to said hydraulic cylinder by a pressure line, an electric motor driving said hydraulic pump, and a cabinet housing said hydraulic pump and said electric motor and having a multi-layer sound insulation; and an oil sump formed in a bottom portion of said cabinet and adapted to be connected by means of an outflow hose with one of a shaft well and a catch tank.

11. The hydraulic drive according to claim 10 wherein said electric motor and said hydraulic pump are enclosed within an oil tank and surrounded by hydraulic oil, said oil tank being mounted in said cabinet.

12. The hydraulic drive according to claim 11 including a first insulation layer enclosing said oil tank and a second insulation layer mounted at an interior wall of said cabinet including at a pivotable door attached to said cabinet.

13. The hydraulic drive according to claim 10 including a drive control equipped with a low-noise soft-starter located in said cabinet and connected to control said electric motor.

14. The hydraulic drive according to claim 10 wherein said cabinet is sized to be positioned adjacent a shaft door of the hydraulic elevator installation.

15. The hydraulic drive according to claim 10 including a control apparatus mounted in said cabinet and connected to said motor.

16. The hydraulic drive according to claim 15 wherein said control apparatus includes a drive control connected to said motor and a car control connected to said drive control.

17. The hydraulic drive according to claim 10 wherein said drive system is assembled as a unit prior to delivery of said cabinet to the site of the hydraulic elevator installation.

* * * * *